US006670981B1

(12) United States Patent
Vincent et al.

(10) Patent No.: US 6,670,981 B1
(45) Date of Patent: Dec. 30, 2003

(54) LASER PRINTING WITH REWRITABLE MEDIA

(75) Inventors: Kent D. Vincent, Cupertino, CA (US); R. Stanley Williams, Redwood City, CA (US); Xiao-an Zhang, Sunnyvale, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 165 days.

(21) Appl. No.: 10/021,446

(22) Filed: Oct. 30, 2001

(51) Int. Cl.[7] ..... B41J 2/435; G03G 17/04
(52) U.S. Cl. ..... 347/264; 347/262; 430/37
(58) Field of Search ..... 347/262, 264, 347/112, 246; 365/151, 178; 430/32, 37

(56) References Cited

U.S. PATENT DOCUMENTS

| | | | | |
|---|---|---|---|---|
| 5,604,027 A | | 2/1997 | Sheridon | 428/323 |
| 6,031,756 A | * | 2/2000 | Gimzewski et al. | 365/151 |
| 6,052,141 A | * | 4/2000 | Takeuchi | 347/246 |
| 6,124,851 A | | 9/2000 | Jacobson | 345/206 |
| 6,411,316 B1 | * | 6/2002 | Shigehiro et al. | 347/112 |

* cited by examiner

*Primary Examiner*—Hai Pham

(57) ABSTRACT

A laser printing system for imaging using plain paper, rewritable media, or both. The rewritable media employs a molecular colorant. The rewritable media is brought into contact with an electrical charge deposited on the surface of a photoconductor drum or belt. Field generated cause the molecules of the colorant to change state to develop the desired text or print image.

34 Claims, 9 Drawing Sheets

LASER PRINTING WITH REWRITABLE MEDIA

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO AN APPENDIX

The present application includes a hard copy appendix comprising pertinent specification pages and drawings of partial co-inventors' U.S. patent application Ser. No. 09/844,862, filed Apr. 27, 2001 by ZHANG et al. for MOLECULAR MECHANICAL DEVICES WITH A BAND GAP CHANGE ACTIVATED BY AN ELECTRIC FIELD FOR OPTICAL SWITCHING APPLICATIONS as relates to subject matter claimed in accordance with the present invention.

BACKGROUND OF THE INVENTION

1. Field of the Invention

The present invention relates generally to printing and, more particularly, to laser printing on rewritable media employing a molecular colorant.

2. Description of Related Art

The majority of printed paper is read once or twice then discarded. Not only is this wasteful of a valuable nature resource (trees), but paper constitutes a significant volume of waste disposal and recycling. There is much interest in providing a paperless office through electronic displays and the Internet. Users, however, find displays to be an inferior alternative to the printed page over a wide range of parameters, such as limited portability of large screen models, substantially fixed viewing location and posture even with portable computers, off-axis viewability issues inherent in some screen technologies, and eyestrain. Thus, there is a growing need and market for a paper or paper-like sheet that can be electronically printed, erased and re-used.

Electrostatically polarized, dichroic particles for displays are well known. Published works such as by Jacques Pankove of RCA date back to at least March 1962 (RCA Technical Notes No. 535). Dichroic spheres having black and white hemispheres are reported separately for magnetic polarization by Lawrence Lee and for electrostatic polarization by Nick Sheridon of Xerox, as early as 1977 (S.I.D. Vol. 18/3 and 4, p. 233 and 239, respectively).

The need for an electronic paper-like print means has recently prompted development of at least two electrochromic picture element (pixel) colorants: (1) a microencapsulated electrophoretic colorant (see e.g., U.S. Pat. No. 6,124,851 (Jacobson) for an ELECTRONIC BOOK WITH MULTIPLE PAGE DISPLAYS, E Ink Corp., assignee), and (2) a field rotatable bichromal colorant sphere (e.g., the Xerox® Gyricon™). Each of these electrochromic colorants is approximately hemispherically bichromal, where one hemisphere of each microcapsule is made the display background color (e.g., white) while the second hemisphere is made the print or image color (e.g., black or dark blue). The colorants are field translated or rotated so the desired hemisphere color faces the observer at each pixel.

Xerox Corporation has been most active in developing dichroic spheres for displays and printer applications. U.S. Pat. No. 4,126,854, issued Nov. 21, 1978 to Sheridon, describes a dichroic sphere having colored hemispheres of differing Zeta potentials that allow the spheres to rotate in a dielectric fluid under this influence of an addressable electric field. In this, and subsequent U.S. Pat. No. 4,143,103, issued Mar. 6, 1979, Sheridon describes a display system wherein the dichroic spheres are encapsulated in a transparent polymeric material. The material is soaked in a dielectric fluid plasticizer to swell the polymer such that cavities form around each dichroic sphere to allow sphere rotation. The same dichroic fluid establishes the Zeta potential electrostatic polarization of the dichroic sphere. In U.S. Pat. No. 5,389,945, issued Feb. 14, 1995, Sheridon describes a printer that images the polymeric sheet containing the dichroic spheres with a linear electrode array, one electrode for each pixel, and an opposing ground electrode plane. In U.S. Pat. No. 5,604,027, issued Feb. 18, 1997, Sheridon describes SOME USES OF MICROENCAPSULATION FOR ELECTRIC PAPER.

The dichroic sphere has seen little commercial exploitation in part because of its high manufacturing cost. The most common reported manufacturing technique involves vapor deposition of black hemispheres on the exposed surface of a monolayer of white microspheres, normally containing titanium dioxide colorants. Methods of producing the microspheres and hemisphere coating are variously described by Lee and Sheridon in the above-identified S.I.D. Proceedings. More recently, Xerox has developed techniques for jetting molten drops of black and white polymers together to form solid dichroic spheres when cooled. These methods include circumferentially spinning jets, U.S. Pat. No. 5,344,594, issued Sep. 6, 1994. Unfortunately, the colliding drops produce swirled colorant about the resultant sphere and it is difficult to prevent agglomeration of molten spheres when the concentration of droplets emitted approaches reasonable volumes. None of these techniques lend themselves to bulk, large-scale production because they lack a continuous, volume process.

Lee has described microencapsulated dichroic spheres within an outer spherical shell to provide free rotation of the colorants within a solid structure. A thin oil layer separates the dichroic sphere and outer shell. This allows the microspheres to be found in solid film layers and overcomes the need to swell the medium binder, as proposed by Sheridon. This technique, however, is generally described for magnetic dichroic spheres in the above-referenced S.I.D. Proceedings authored by Lee.

Sheridon describes an electrode array printer for printing rewritable paper in U.S. Pat. No. 5,389,945, issued Feb. 14, 1995. Such a printer relies on an array of independently addressable electrodes, each capable of providing a localized field to the rewritable media to rotate the dichroic spheres within a given pixel area. Although electrode arrays provide the advantage of a potentially compact printer, they are impractical for microcapsule dichroic sphere technologies from both cost and print speed standpoint. Each electrode must have its own high voltage driver to produce voltage swings of 500–600 volts across the relatively low dielectric rewritable paper thickness to rotate the dichroic spheres. Such drivers and their interconnects across an array of electrodes makes electrode arrays costly. The print speed achievable through electrode arrays is also significantly limited because of the short nip time the paper experiences within the writing field. The color rotation speed of dichroic spheres under practical field intensities is in the range of 20 msec or more. At this rate, a 300 dpi resolution printer employing an electrode array would be limited to under one page per minute print speed.

Thus, it can be seen that electrode array printing techniques using microcapsule-based electronic media impose resolution, cost and speed limits upon rewritable media printing, and hinder the exploitation for many commercial applications. Therefore, there is an unresolved need for a printing technique that can quickly and inexpensively print to rewritable media at high resolution. More specifically, there is a need for a media for use with a laser printer wherein the media colorant has superior characteristics and advantages over microcapsule-based types.

BRIEF SUMMARY OF THE INVENTION

In its basic aspect, the present invention provides a hard copy system including: a rewritable medium having a molecular colorant; and a laser printer for generating electric fields associated with said molecular colorant for writing and erasing a print image therewith.

In another aspect, the present invention provides a printer for a rewritable medium, the medium having at least one layer of a rewritable molecular colorant, the printer including: a photoconductor means for storing a voltage charge deposited thereon; writing means for writably erasing the charge deposited on the photoconductor means; and support means for holding the rewritable medium proximate to the photoconductor means in a nip contact area such that when the rewritable medium passes a charge written on the photoconductor means, fields generated from the photoconductor means cause a molecular state change of pixel locations of said molecular colorant to develop a print image on the rewritable medium.

In another basic aspect, the present invention provides a printing process including: depositing an electric charge distribution on a photoconductor wherein said distribution is representative of a printing image; writably erasing the charge deposit deposited on the photoconductor; and transporting a rewritable medium proximate to the photoconductor through a nip contact are, the rewritable medium having at least one layer of a molecular colorant such that when the rewritable medium passes the charge written photoconductor, fields generated from the photoconductor cause a molecular state change of pixel locations of said molecular colorant and thereby developing a print image associated with said writably erasing.

The foregoing summary is not intended to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P. 608.01(d) merely to apprise the public, and more especially those interested in the particular art to which the invention relates, of the nature of the invention in order to be of assistance in aiding ready understanding of the patent in future searches. Other objects, features and advantages of the present invention will become apparent upon consideration of the following explanation and the accompanying drawings, in which like reference designations represent like features throughout the drawings.

BRIEF DESCRIPTION OF THE DRAWINGS

In accordance with 37 C.F.R. 1.84(u), in order to prevent confusion with FIGURES of the Appendix hereto, the drawings of this application use double capital letter suffices.

Figure 1A:
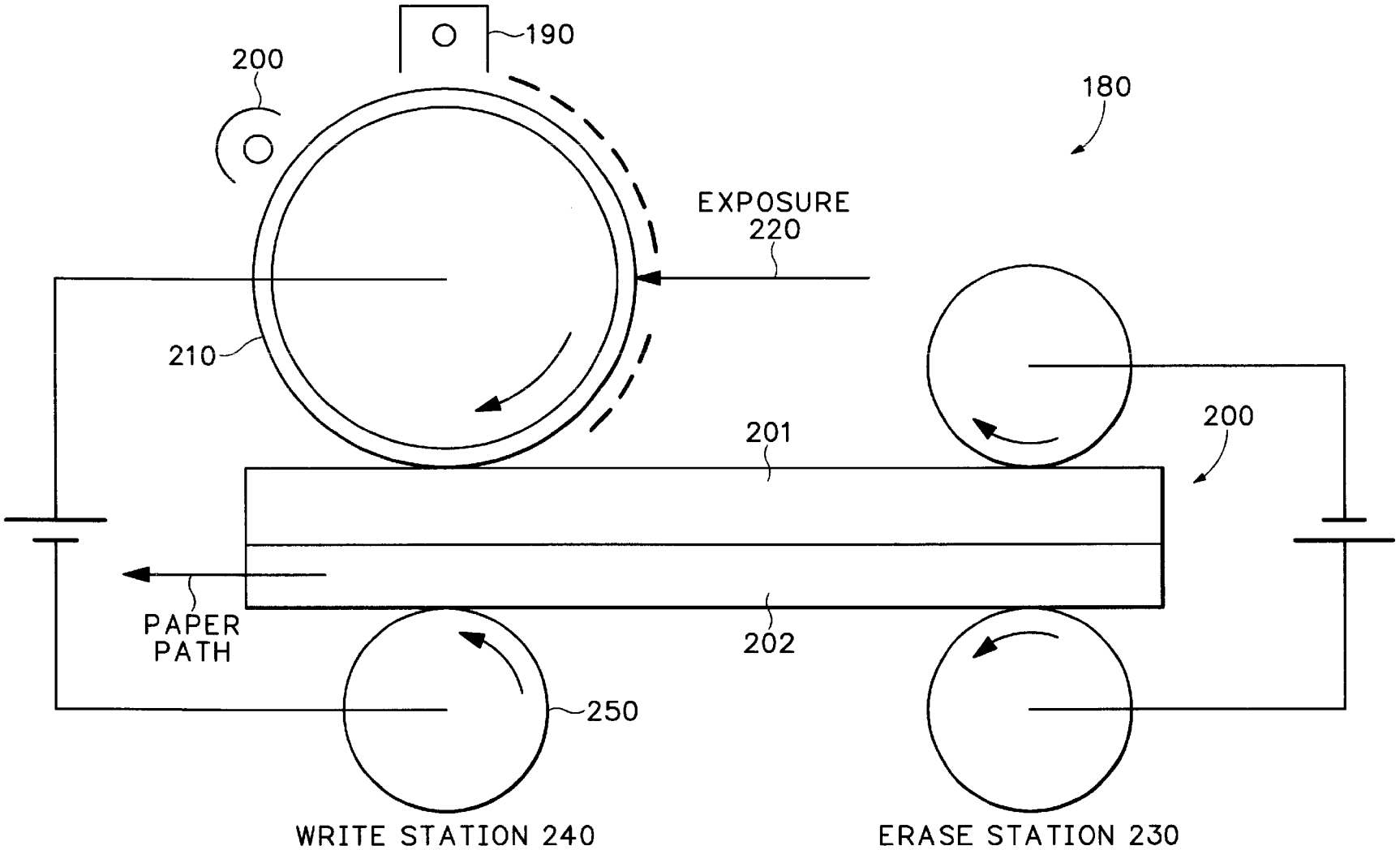
FIG. 1AA is a diagram illustrating an embodiment of a rewritable medium printer and a molecular colorant print medium according to the present invention in a schematic elevation view.

The drawings referred to in this specification should be understood as not being drawn to scale except if specifically annotated.

DETAILED DESCRIPTION OF THE INVENTION

Subtitles used herein are for the convenience of the reader; no limitation on the scope of the invention is intended by the inventors nor should any be implied therefrom.

Definitions

The following terms and ideas are applicable to both the present discussion and the Appendix hereto.

The term "self-assembled" as used herein refers to a system that naturally adopts some geometric pattern because of the identity of the components of the system; the system achieves at least a local minimum in its energy by adopting this configuration.

The term "singly configurable" means that a switch can change its state only once via an irreversible process such as an oxidation or reduction reaction; such a switch can be the basis of a programmable read-only memory (PROM), for example.

The term "reconfigurable" means that a switch can change its state multiple times via a reversible process such as an oxidation or reduction; in other words, the switch can be opened and closed multiple times, such as the memory bits in a random access memory (RAM) or a color pixel in a display.

The term "bistable" as applied to a molecule means a molecule having two relatively low energy states (local minima) separated by an energy (or activation) barrier. The molecule may be either irreversibly switched from one state to the other (singly configurable) or reversibly switched from one state to the other (reconfigurable). The term "multi-stable" refers to a molecule with more than two such low energy states, or local minima.

The term "bi-modal" for colorant molecules in accordance with the present invention may be designed to include the case of no, or low, activation barrier for fast but volatile switching. In this latter situation, bistability is not required, and the molecule is switched into one state by the electric field and relaxes back into its original state upon removal of the field; such molecules are referred to as "bi-modal". In effect, these forms of the bi-modal colorant molecules are "self-erasing". In contrast, in bistable colorant molecules the colorant molecule remains latched in its state upon removal of the field (non-volatile switch), and the presence of the activation barrier in that case requires application of an opposite field to switch the molecule back to its previous state. Also, "molecular colorant" as used hereinafter as one term to describe aspects of the present invention is to be distinguished from other chemical formulations, such as dyes, which act on a molecular level; in other words, "molecular colorant" used hereinafter signifies that the colorant molecules as described in the Appendix and their equivalents are employed in accordance with the present invention.

Micron-scale dimensions refers to dimensions that range from 1 micrometer to a few micrometers in size.

Sub-micron scale dimensions refers to dimensions that range from 1 micrometer down to 0.05 micrometers.

Nanometer scale dimensions refers to dimensions that range from 0.1 nanometers to 50 nanometers (0.05 micrometers).

Micron-scale and submicron-scale wires refers to rod or ribbon-shaped conductors or semiconductors with widths or diameters having the dimensions of 0.05 to 10 micrometers, heights that can range from a few tens of nanometers to a micrometer, and lengths of several micrometers and longer.

"HOMO" is the common chemical acronym for "highest occupied molecular orbital", while "LUMO" is the common chemical acronym for "lowest unoccupied molecular orbital". HOMOs and LUMOs are responsible for electronic conduction in molecules and the energy difference between the HOMO and LUMO and other energetically nearby molecular orbitals is responsible for the color of the molecule.

An "optical switch," in the context of the present invention, involves changes in the electro-magnetic properties of the molecules, both within and outside that detectable by the human eye, e.g., ranging from the far infra-red (IR) to deep ultraviolet (UV). Optical switching includes changes in properties such as absorption, reflection, refraction, diffraction, and diffuse scattering of electromagnetic radiation.

The term "transparency" is defined within the visible spectrum to mean that optically, light passing through the colorant is not impeded or altered except in the region in which the colorant spectrally absorbs. For example, if the molecular colorant does not absorb in the visible spectrum, then the colorant will appear to have water clear transparency.

The term "omni-ambient illumination viewability" is defined herein as the viewability under any ambient illumination condition to which the eye is responsive.

As a general proposition, "media" in the context of the present invention includes any surface, whether portable or fixed, that contains or is layered with a molecular colorant or a coating containing molecular colorant in accordance with the present invention wherein "bistable" molecules are employed; for example, both a flexible sheet exhibiting all the characteristics of a piece of paper and a writable surface of an appliance (be it a refrigerator door or a computing appliance using the molecular colorant). "Display" (or "screen") in the context of the present invention includes any apparatus that employs "bi-modal" molecules, but not necessarily bistable molecules. Because of the blurred line regarding where media type devices ends and display mechanisms begin, no limitation on the scope of the invention is intended nor should be implied from a designation of any particular embodiment as a "media" or as a "display."

As will become apparent from reading the Detailed Description and Appendix, "molecule" can be interpreted in accordance with the present invention to mean a solitary molecular device, e.g., an optical switch, or, depending on the context, may be a vast array of molecular-level devices, e.g., an array of individually addressable, pixel-sized, optical switches, which are in fact linked covalently as a single molecule in a self-assembling implementation. Thus, it can be recognized that some molecular systems comprise a super-molecule where selective domain changes of individual molecular devices forming the system are available. The term "molecular system" as used herein refers to both solitary molecular devices used systematically, such as in a regular array pixel pattern, and molecularly linked individual devices. No limitation on the scope of the invention is intended by interchangeably using these terms nor should any be implied.

Apparatus General Description

Reference is made now in detail to a specific embodiment of the present invention, which illustrates the best mode presently contemplated for practicing the invention. Alternative embodiments are also briefly described as applicable.

The rewritable media of the present invention comprises a substrate, such as paper or film, having thereon or therein a bistable, bichromal molecular colorant that is color responsive to an electric field. An electric field of a first polarity applied across the colorant will affect bistable colorant molecules thereof so as to display a first color. An electric field of the opposing polarity applied across the colorant will affect colorant molecules so as to render them transparent or to display a second color. The induced bistable molecular states remains stable over a prolonged period of time, if not indefinitely, in the absence of an applied electric field.

Figure 2A:
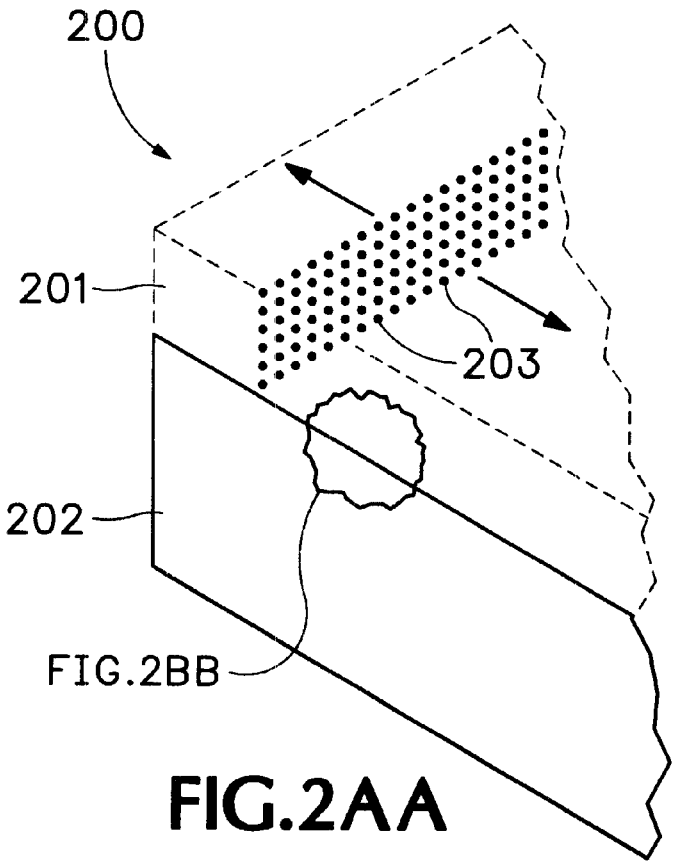
FIG. 2AA and 2BB are schematic diagrams of a rewritable media in accordance with the present invention as used in conjunction with the printer of FIG. 1AA wherein FIG. 2BB is a detail of FIG. 2AA.

FIG. 1AA shows a laser printing system 180 in a dedicated embodiment for a rewritable molecular colorant medium 200 of FIGS. 2AA and 2BB. The write station 240 is comprised of a standard laser printer photoconductor, charging and light writing apparatus as is well known in the art. Charge produced on a photoconductor 210 drum, or belt, by a corona charger, or like device, 190 is "written" preferentially by an impinging laser beam or other light exposure device 220. An electric field is established through the rewritable print medium 140 when the medium 140 passes between the photoconductor 210 and a back electrode 250 roller. The field polarity and magnitude will fluctuate according to the charge characteristics of the virtual image (relative charge intensity) on the photoconductor 210 causing the image to be recorded on the rewritable medium 140 through reorientation of the colorant molecule 203 states. After printing, any remaining charge on photoconductor 210 is "erased" by charge eraser 200, normally a page-wide illumination source.

Alternately, back electrode 250 roller is not biased, but is allowed to float with respect to the charge stored on photoconductor 210. In such a case, the roller simply acts as a support structure to hold medium 140 proximate to photoconductor 210 as the charge stored on photoconductor 210 causes rewritable medium 140 to record the image.

Although FIG. 1AA shows a separate erase station 230, alternately, proper biasing of the back electrode 250 can eliminate the need for a separate erase station 230. For example, a nominal organic photoconductor may be charged to −600V and discharged to −100V when exposed to light. By applying a bias on the back electrode 250 of −350V, the developed field across the rewritable medium 140 will be −250V whenever the still-charged region of the photoconductor 210 contacts the medium 140.

Molecular Colorant Print Media

Figure 2B:
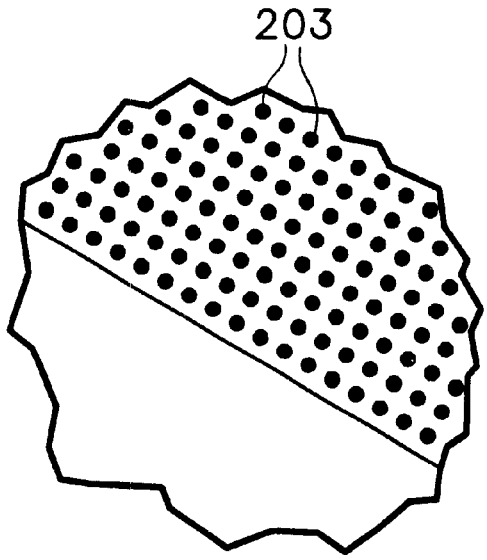

As illustrated schematically in a magnified partial view in FIG. 2AA, electronic print media 200 in accordance with one embodiment of the present invention comprises an electrochromic coating 201 affixed superjacently to a backing 202 substrate. The media 200 of the present invention employs an electrochromic molecular colorant coating 201 layer (phantom line illustration is used to demonstrate that the layer can in fact be transparent as described hereinafter and also to denote that the layer is very thin, e.g., on the order of a few microns) that contains bistable, electrochromic molecules 203 (represented by greatly magnified dots) that undergo conformational changes as a result of application of an electric field that in effect changes selectively localized regions of this coating from one hue to another. In order to describe the invention, the electrochromic molecules themselves are depicted as simple dots 203 in FIG. 2BB; however, it should be recognized that there are literally millions of such molecules (in unlinked system terms) per cubic micron of colorant; this can be thought of also as millions of molecular optical switching devices per cubic micron of colorant in a linked molecular system.

Optionally, note that as the molecular colorant is spatially addressable at its molecular scale, the colorant molecules may be commingled with molecules of the substrate. Incorporated substrate coloration and fabrication processes are well known in the print media art.

Bichromal Molecules for Electrochromic Colorants

In order to develop a molecular colorant suitable for rewritable media, what is needed is a molecular system that avoids chemical oxidation and/or reduction, permits reasonably rapid switching from a first state to a second, is reversible to permit real-time or video rate writing-erasing applications, and can be adapted for use in a variety of optical devices.

The present invention introduces the capability of using molecules for optical switches, in which the molecules change color when changing state. This property can be used for a wide variety of write-read-erase devices or any other application enabled by a material that can change color or transform from transparent to colored. The present invention introduces several new types of molecular optical property switching mechanisms: (1) an electric (E) field induced rotation of at least one rotatable section (rotor) of a molecule to change the band gap of the molecule; (2) E-field induced charge separation or re-combination of the molecule via chemical bonding change to change the band gap; (3) E-field induced band gap change via molecule folding or stretching. These devices are generically considered to be electric field devices, and are to be distinguished from electrochemical devices.

The co-pending U.S. Pat. Appl., partially incorporated herein as the Appendix, by Zhang et al. for MOLECULAR MECHANICAL DEVICES WITH A BAND GAP CHANGE ACTIVATED BY AN ELECTRIC FIELD FOR OPTICAL SWITCHING APPLICATIONS, supra, describes in detail a plurality of embodiments of bichromal molecules which can be used in accordance with the present invention.

With respect to the technology as described in the Appendix, the overwhelming advantage of electrochromic molecular colorants over microcapsule technology (see, Background of the Invention, supra) for electronic print media is realization of standardized, conventional hard copy quality, print contrast, image resolution, switching speed, and color transparency. Such use of electrochromic molecular colorants will provide readable content that resembles conventional printing dyes on paper forms in color mode, color density, and coating layer incorporability. In the transparent state, the bichromal molecules 203 of the present invention do not absorb any visible light appreciably, allowing a media substrate 202 to fully show through the coating layer 201. Thus, to the observer an electrochromic molecular colorant image appears substantially identical to the image as it would appear in conventional ink print on paper. Namely, gradations of the specific high density color, if any, are invisible to the naked eye. The term "electrochromic molecular colorant" as used herein is expressly intended to include a plurality of different colorant molecules blended to form a layer that can achieve a desired composite color other than the exemplary black state.

Note additionally, the electrochromic molecular colorant is spatially addressable at its molecular (Angstrom) scale, allowing far greater image resolution than the tens-of-microns-scale of microcapsule colorants.

The color switching time for the electrochromic molecular colorant pervaded pixel regions of the media 200 is significantly shorter than that for microcapsule colorants, allowing significantly faster imaging speeds, in the main because the electrochromic molecules of the colorant are substantially stationary and change color either through the movement of electrons, the twisting of molecular elements, or both. In each case, the total mass in movement for any addressed pixel is many orders of magnitude smaller than that required with microcapsule colorants; note also that there is additionally no viscous drag component.

Electric Field Addressable Rewriteable Media Using Bichromal Colorant

A rewritable print media invention is described in co-inventors' co-pending patent application U.S. Ser. No. 09/919394, filed Jul. 31, 2001. Similarly thereto, in a first embodiment the present invention comprises an electrical field addressable, rewritable media 200 using a bichromal electrochromic molecular colorant. As the colorant is active at a molecular level, it may be formed in a number of ways. Embodiments that are self-assembling, formed using impregnation, or a coating with a liquid, paint, ink, or as an otherwise adapted form liquid vehicle on a substrate 202, are all within the scope of the invention. The molecular colorant may be a self-assembling system or have a carrier or vehicle for applying the colorant to a substrate using conventional deposition and drying (or curing) techniques. The various types of vehicles are discussed in more detail hereinbelow.

The present media 200 invention contemplates a wide variety of substrate 202 materials and forms. As merely one example directed toward printer and plain paper-like application uses, the coating 201 may be affixed onto a plastic or other flexible, durable, material substrate 202 in the approximate size, thickness, and shape of commercial stationery or other printable media. The particular substrate 202 composition implemented is fully dependent on the specific application and, particularly, to the role that the substrate plays in supporting or creating the electric field that is imposed across the coating 201 layer. In fact, the molecular coating, at least in a bistable molecular system form, can be used with any surface upon which writing or images can be formed.

The Molecular System Erasably Writeable Surface

The general nature of the molecular colorant on the media in accordance with the present invention is described in detail in the Appendix hereto. In a preferred embodiment related to the present invention, a coating layer 201 of the media 200 comprises electrochromic molecules 203 (FIGS. 2AA–2BB)—self-assembling or molecules in association with another chemical component, the "vehicle"—having an electrical field responsive high color density state (hereinafter simply "color state") and a transparent state, or two highly contrasting color states, e.g., a black state and a color state (e.g., yellow). The vehicle may include binders, solvents, flow additives, or other common coating additives appropriate for a given implementation.

Preferably, the colorant of the coating 201 obtains a color state (e.g., black) when subjected to a first electrical field and a transparent state when subjected to a second electrical field. The coating 201—or more specifically, the addressable pixel regions of the media 200—in a preferred embodiment is bistable; in other words, once set or written, the field targeted, "colored pixel," molecules form the "printed content," remaining in the current printed state until the second field is applied, intentionally erasing the image by returning the molecules to their transparent state at the field targeted pixels. Again, it must be recognized that there may be millions of such switched molecule in any given pixel. No holding electrical field is required to maintain the printed content.

Although very different in constitution, the coating composition of this invention is analogous to conventional coating formulation technology. The constituents of the colorant will depend on the rheology and adhesion needs of the printing/coating process and substrate material. In some implementations, the colorant strata will be self-assembling. Typically, the coating 201 layer will compose 1%–30% of the solid content of the film deposited to form the coating 201 layer on the substrate 202. This amount is usually determined by desired image color density. The coating 201 may include a polymeric binder to produce a dried or cured coating 201 layer on the substrate 202 in which the electrochromic molecular colorant is suspended. Alternatively, the solids content may include as much as 100% colorant for certain known manner evaporative deposition methods or other thin film deposition methods wherein the colorant, or an associated vehicle, is deposited. In the case of deposition-evaporation methods, there may be no associated vehicle. In some instances, the colorant must be pre-oriented within the deposited coating 201 layer to allow an optimum alignment with the electrical field that will be used to write and erase a printed content. Such orientation may be achieved by solidifying the deposited coating 201 layer under the influence of a simultaneously applied electric field across the media 200. In one specific embodiment, the coating 201 comprises electrochromic molecular colorant and a liquid, ultraviolet light ("UV") curable, prepolymer (e.g., (meth) acrylate or vinyl monomers/oligomers). The polymer in this instance is formed in situ on the media substrate 202 when subjected to ultraviolet radiation. Such prepolymers are well known in the coatings art.

In a second specific embodiment, coating solidification may occur through thermally activated vehicle chemical reaction common to epoxy, urethane, and thermal free radical activated polymerization.

In a third specific embodiment, coating solidification may occur through partial or total vehicle evaporation.

The colorant may also self-orient through colorant/coating design that allows a self-assembled lattice structure, wherein each colorant monomer aligns with adjacent colorant monomers. Such design and lattice structures, for example, are common to dendrimers and crystals. Processes for self-assembly may include sequential monolayer deposition methods, such as well known Langumir film and gas phase deposition techniques.

The Substrate

The construction of any specific implementation of the media is dependent upon the writing means. Overall, the substrate may be flexible, semi-flexible, or rigid. It may comprise structures as a film, foil, sheet, fabric, or a more substantial, preformed, three-dimensional object. It may be electrically conductive, semi-conductive, or insulative as appropriate for the particular implementation. Likewise, the substrate may be optically transparent, translucent or opaque, or colored or uncolored, as appropriate for the particular implementation. Suitable substrate materials may be composed, for example, of paper, plastic, metal, glass, rubber, ceramic, wood, synthetic and organic fibers, and combinations thereof. Suitable flexible sheet materials are preferably durable for repeated imaging, including for example resin impregnated papers (e.g. Appleton Papers Master Flex™), synthetic fiber sheets (e.g., DuPont™ Tyvex™), plastic films (e.g., DuPont Mylar™, General Electric™ Lexan™, and the like) elastomeric films (e.g., neoprene rubber, polyurethane, and the like), woven fabrics (e.g., cotton, rayon, acrylic, glass, metal, ceramic fibers, and the like), and metal foils, wherein it is preferable that the substrate be conductive or semi-conductive; it should have a conductive layer in near contact with the molecular colorant layer 201, or have a high dielectric constant bulk property to minimize voltage drop across the substrate. Conductive substrates include metals, conductive polymers, ionic polymers, salt and carbon filled plastics and elastomers, and the like. Suitable semi-conductive substrates may be composed of conventional doped silicon and the like. Substrates with a conductive layer include metal clad printed circuit board, indium tin oxide coated glass, ceramics, and the like. Vapor deposited or grown semiconductor films on glass, ceramic, metal or other substrate material may also be used. Each of these substrates are commercially available. High dielectric constant materials include metal-oxide ceramics such as titania. Suitable substrates may be composed of sintered ceramic forms, woven ceramic fabric, or ceramic filled plastics, elastomers and papers (via ceramic-resin impregnation). Translucent substrates may be used in applications where ambient illumination and backlit viewing options are made available on the same substrate. In general, it is desirable that the translucent substrate appear relatively opaque white under ambient viewing conditions and transparent white under backlit viewing conditions. Suitable translucent substrates include crystalline and semi-crystalline plastic, fiber sheets and film (e.g., Dupont Tyvex), matte-surfaced plastic films (e.g., DuPont matte-finish Mylar and General Electric matte-finish Lexan), commercial matte-surfaced glass, and the like.

Specific Apparatus and Operation of the Present Invention

For one embodiment such as exemplified in FIG. 1AA, the field voltage on the photoconductor 210 fluctuates from −250 to +250V and the back electrode is set approximately half way between the photoconductor charge and discharge voltages. In general, the formula would be:

$$\text{transfer roller bias} = \frac{Vc - Vdc}{2}$$

where Vc=charged photoconductor, and Vdc=discharged photoconductor (pixel area).

Erase time and write time can be made the same, and therefore optimized from a printer design viewpoint, because write E fields and erase E fields generated by biasing in this manner have equal magnitudes, but opposite direction.

Figure 3A:
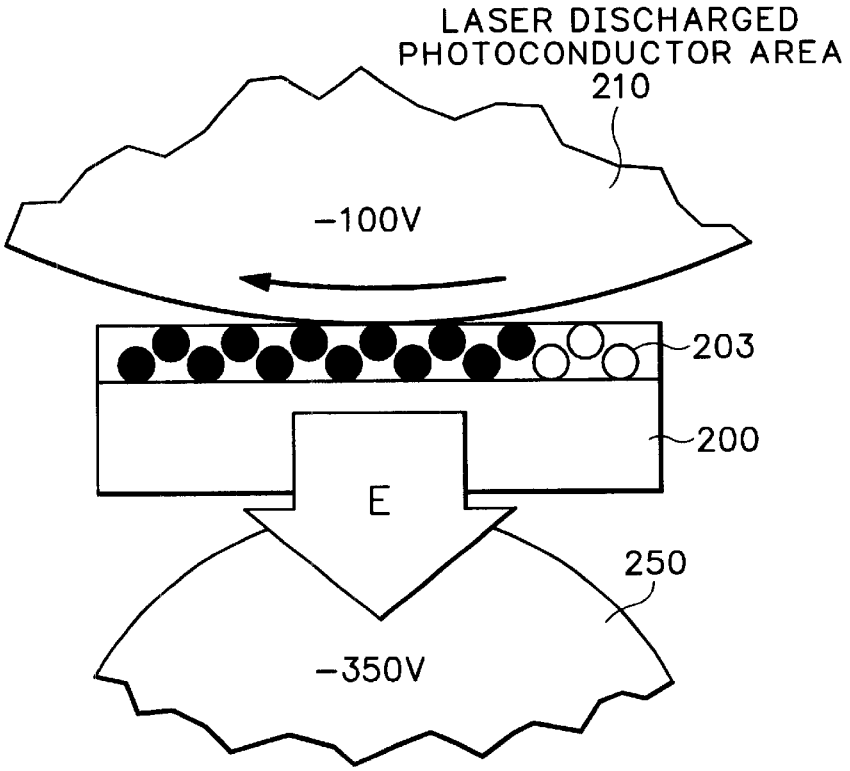
FIG. 3AA illustrates the writing of a black region.

FIG. 3AA illustrates the writing of a black region of pixels as practiced according to one embodiment of the present invention. In FIG. 3AA, a portion of photoconductor 210 has been writably erased by laser to discharge the portion. The discharge establishes a bias of −100V on this portion of photoconductor 210 proximate to transfer roller 250. Because transfer roller 250 is biased at −350V, the downward field E is created between photoconductor 210 and transfer roller 250. This field causes the colorant molecules 203 to orient themselves into their color state, e.g., black.

Figure 3B:
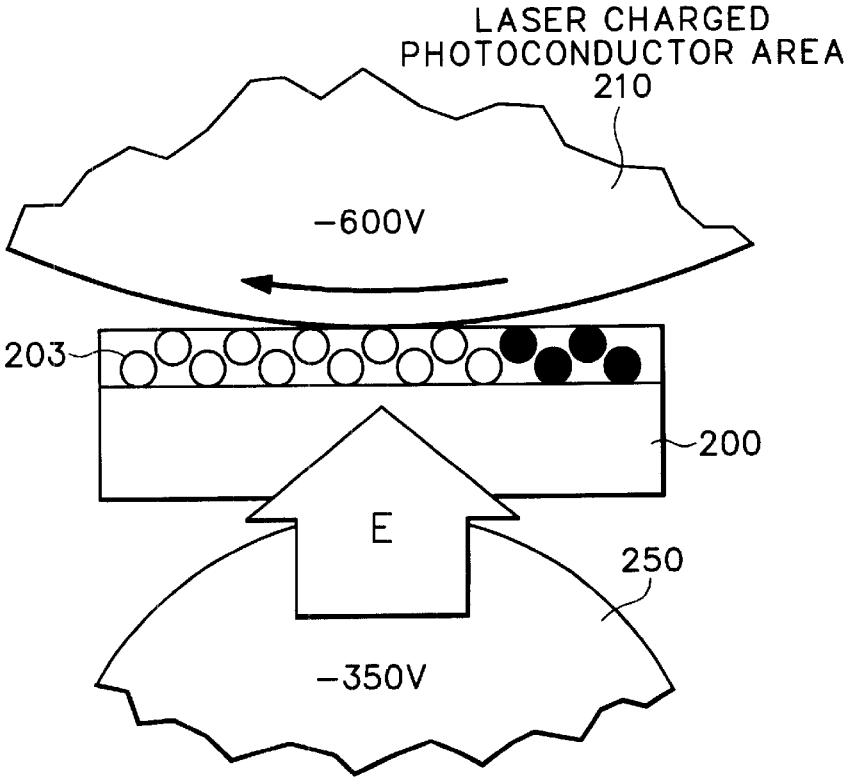
FIG. 3BB illustrates the writing of a white region as practiced according to one embodiment of the present invention.

FIG. 3BB illustrates the writing of a white region of pixels (assuming the substrate 202 is an opaque white) as practiced according to one embodiment of the present invention. In FIG. 3BB, a portion of photoconductor 210 remains charged because it has not been discharged by laser. The charge establishes a bias of −600V on this portion of photoconductor 210 proximate to transfer roller 250. Because transfer roller 250 is biased at −350V, the upward field E is created between photoconductor 210 and transfer roller 250. This field causes the colorant molecules 203 to orient into their transparent state as they pass between photoconductor 210 and transfer roller 250.

Figure 4A:
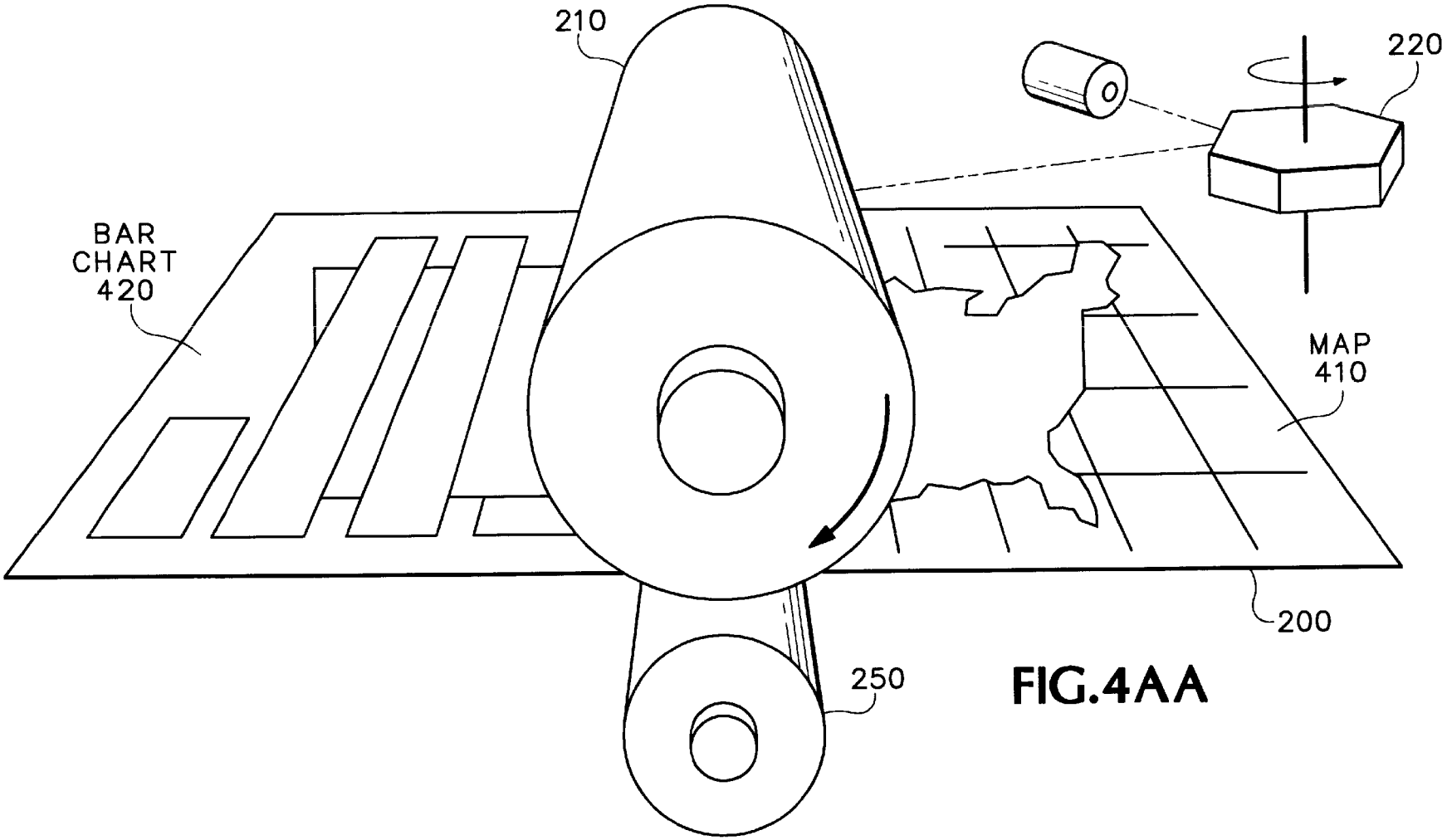
FIG. 4AA illustrates simultaneous erasure and re-write as practiced according to one embodiment of the present invention.

FIG. 4AA illustrates simultaneous erasure and re-write as practiced according to one embodiment of the present invention. In FIG. 4AA laser scanner 220 writable erases the charge on photoconductor 210. This writable erasure creates a bias between photoconductor 210 and transfer roller 250 sufficient to cause bar chart image 420 to be recorded as rewritable medium 140 passes between photoconductor 210 and transfer roller 250. At the same time bar chart image 420 is being written, the bias between photoconductor 210 and transfer roller 250 causes map image 410 (previously recorded on rewritable medium 140) to be erased.

This scenario, wherein the photoconductor 210 serves to both write the new image while simultaneously erasing the former image is, of course, highly desirable because a separate erase station 230 will normally add parts to laser printer system 180. It is anticipated, however, that operating a back electrode 250 bias of such a magnitude may reduce the developed field strength for write and erase below that required for some microcapsule 100 materials, or that the colorant molecules 203 may be designed for greater field strengths to add greater image stability and resistance to erasure by exposure to fields found in the office or home. In such cases, the back electrode 250 bias must be lower, if not grounded, to optimize the field strength in the image writing mode. As such, a separate erase station 230 will be necessary.

The erase station 230 (FIG. 1AA) is located upstream of the photoconductor 210 as measured along the printer paper path. The erase station 230 creates a field of the correct polarity and magnitude to orient all of the colorant molecules 203 in the same direction so that any previous image is eliminated. It should be understood that a number of image field and erase field orientations are possible. For example, the erase station 230 could produce a solid black image so that the photoconductor 210 would write the white background image of a document. More intuitively, perhaps, the erase station 230 will produce a solid white page so that the photoconductor 210 writes the black image. Such a design decision will be determined by the charge species attached to the portions of the colorant molecules 203 and the polarity of the charge produced on the photoconductor 210. The electrodes composing the erase station 230 can be designed as opposing parallel plates, a set of rollers (shown) or any suitable configuration capable of producing the desired field across the rewritable medium 140. In the case of rollers, it may be desirable to coat the roller surface with a dielectric to prevent arcing between the rollers.

Laser Printer Capable of Printing with Toner and on Rewritable Molecular Colorant Media As an alternative embodiment, the electric field writable and erasable medium 140 can be printed in a standard desktop or other laser printer—the same printer retaining its ability to print with conventional paper-like media using toner. Only minor additions and enhancements to such laser printer are required. It is believed that such a printer will have broad marketability as an introductory product that bridges conventional printing with a much more environmentally clean printer approach.

Figure 7A:
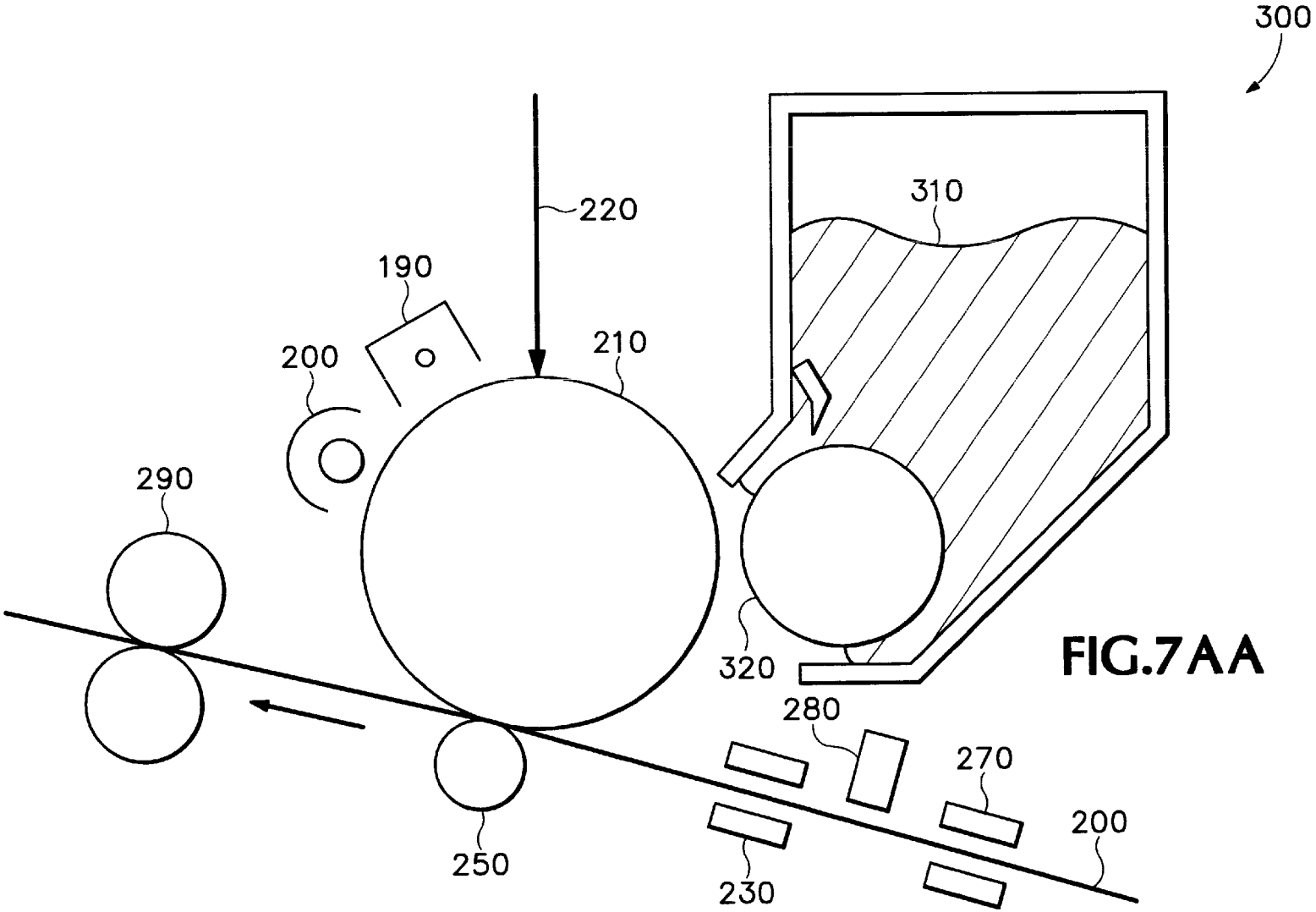
FIG. 7AA is a diagram illustrating a dual-mode printer embodiment of a rewritable medium printer according to the present invention.

FIG. 7AA is a diagram illustrating a dual-mode (i.e., toner and rewritable mode) printer 300 embodiment of an alternative embodiment printer according to the present invention. The writing technique of this invention can produce far superior image quality on a rewritable paper 140 than with conventional electrophotographic toner development on normal paper from the same printer 300. This is because the rewritable paper 140 is imaged as a contact print with the photoconductor 210 and hence will not experience dot broadening to the extent produced by repelling toner particles and electrostatic transfer.

A necessary step in producing an acceptable image on rewritable media with the dual-mode laser printer 300 is to disable the toner development station 310. Mechanical displacement of developer roller 320 from photoconductor 210, or blocking toner transfer through a shield (not shown) placed between the same, are workable solutions. Alternately, controlling the bias on the developer roller 320 to prevent toner development appears simpler and least intrusive to existing laser printer designs.

Figure 5A:
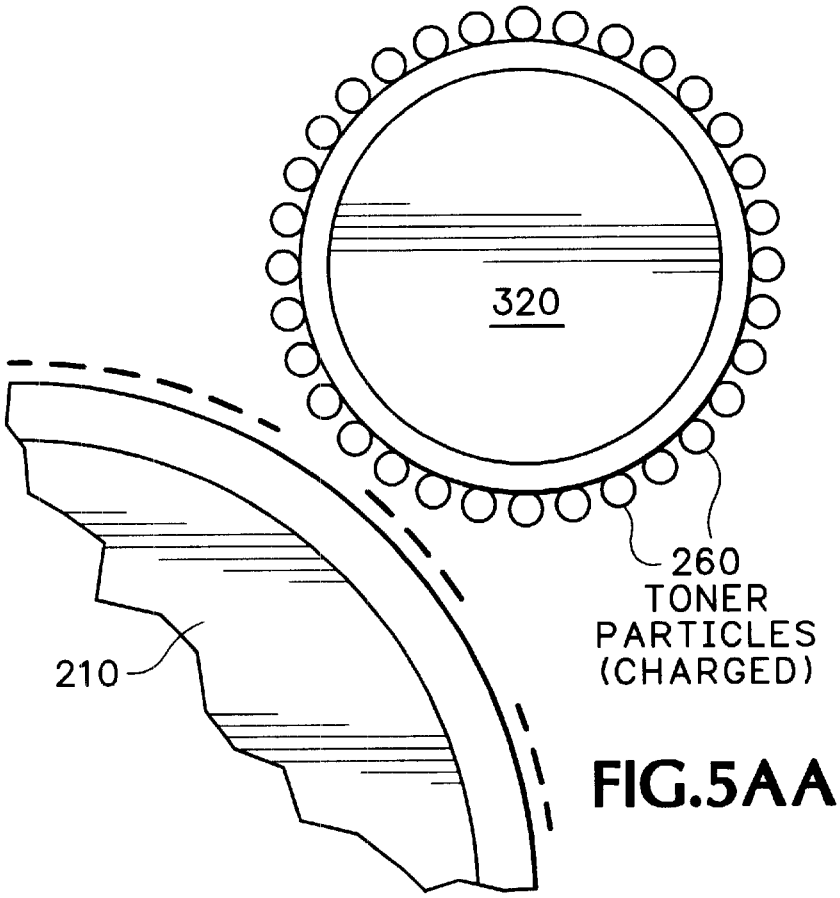
FIG. 5AA is a diagram illustrating a development roller and photoconductor embodiment of a rewritable medium printer according to the present invention.

For reference, an exemplary standard configuration of developer roller 320 and photoconductor 210 is shown in FIG. 5AA. Although there are many development devices, the common aim is to produce a uniform layer of toner particles 260 on the development roller 320, each particle 260 having like charge polarity. In normal toner development mode, FIG. 8AA, a bias is placed on the developer electrode 320 (roller) to help push toner from the development roller 320 to the discharged area of the photoconductor 210 (in the case of discharged area development). This bias is held at a level between the charged area voltage of the photoconductor 210 and discharged area voltage. When the developer electrode 320 bias is dropped approximate to or below the photoconductor 210 discharge voltage (often referred to as residual voltage), FIG. 9AA, the developed fields between the developer roller 320 and photoconductor 210 either push toner to the developer roller 320 or have insufficient magnitude to move the toner off the development roller 320.

Thus, with simple electronic control, the developer can be switched from normal toner development mode to a toner disable mode allowing tonerless printing of the rewritable medium of this invention. The developer electrode 320 voltage should be selected to also prevent development of wrong sign toner.

Figure 8A:
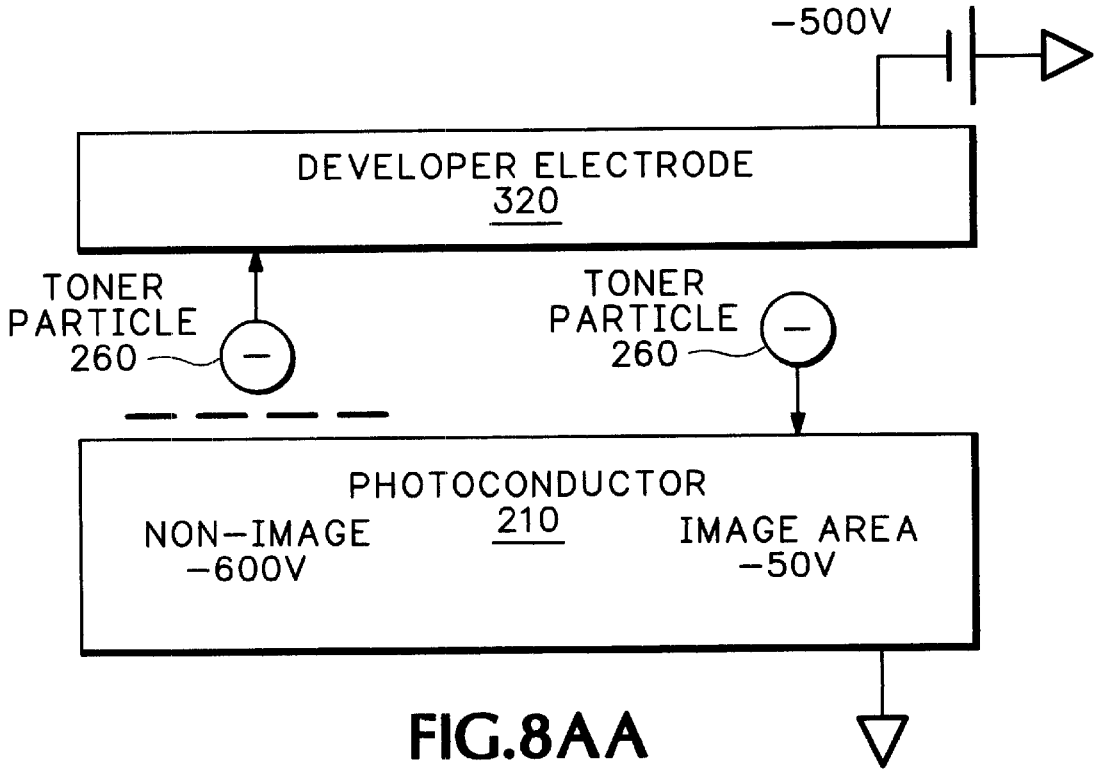
FIG. 8AA is a diagram illustrating a toner development mode embodiment of a rewritable medium printer according to the present invention.
Figure 9A:
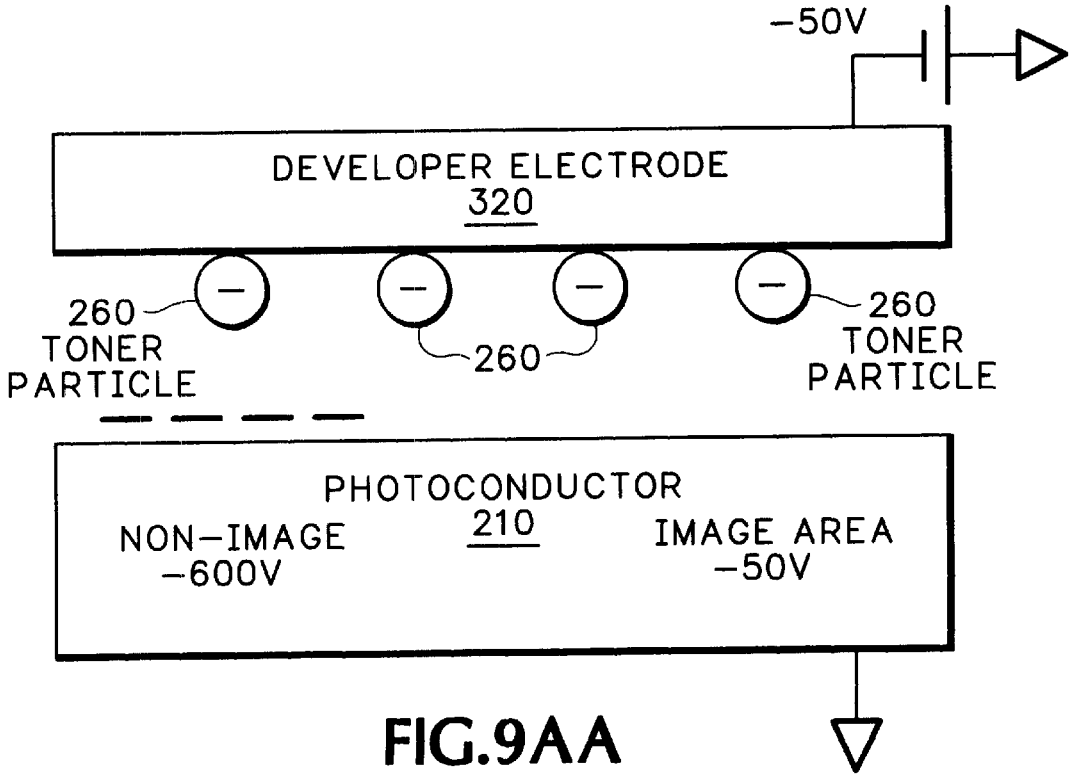
FIG. 9AA is a diagram illustrating a toner disable mode embodiment of a rewritable medium printer according to the present invention.

FIGS. 8AA and 9AA are given as a single example of how the development roller 320 bias may be changed to disable toner development. It is noted that other development modes, such as charged area development or toner charge polarity, different from that shown here may benefit from this technique. The basic concepts still apply and will not be further discussed here.

As with the developer 310, the laser printer fuser station 290 must be disabled whenever rewritable paper is "printed." Obviously, the heat generated by the fuser 290 can easily be disabled by cutting power to the heating elements.

The rewritable paper concept described herein is readily adapted to auto-detection of paper type. Although several paper sensing techniques are possible for discerning normal from rewritable paper, for example photodetection of watermarks fabricated into rewritable sheet, one technique seems most elegant. In this case, an electrode upstream from the erasure electrode is placed to bias the molecular colorant located at some location on a sheet (e.g., margin) to write black. A photosensor located along the same paper path can detect whether the bias produced black (rewritable paper) or had no effect (regular paper). After detection, the test mark is erased via the erasure station or photoconductor.

In the event that rewritable paper is detected when normal (toner) printing was specified, the printer could stop the print operation and indicate the mismatch to the user. Similarly, the printer could also stop the print operation and indicate the mismatch to the user in the event that non-rewrite paper is detected when rewritable printing was specified. Alternately, in the case of a dual-mode printer, the printer could automatically change from rewrite mode to toner mode and then print to the regular paper.

Figure 6A:
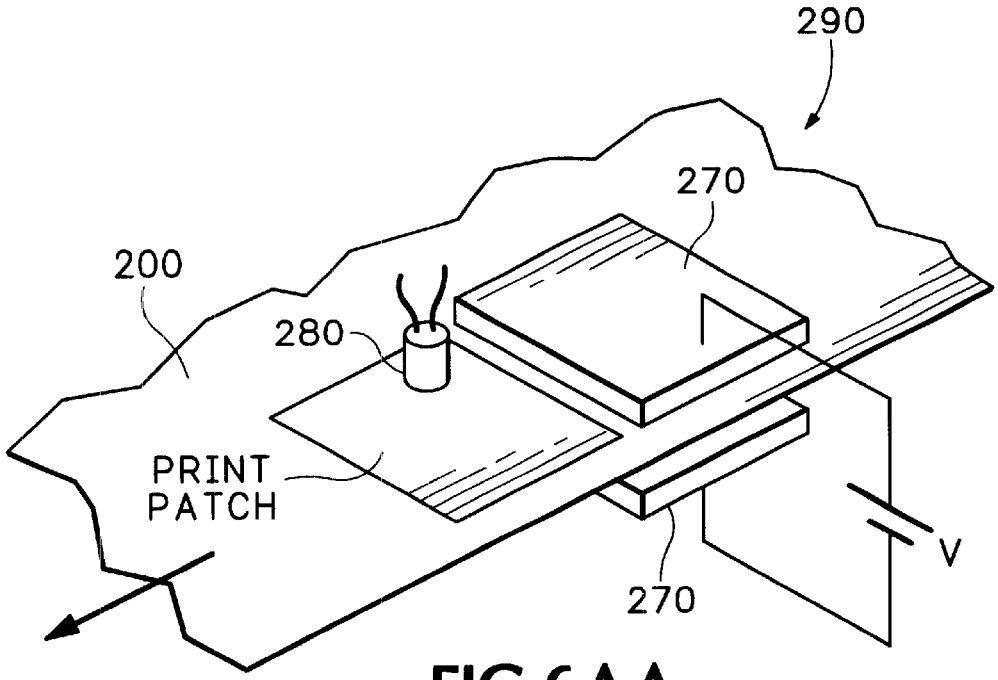
FIG. 6AA is a diagram illustrating a rewritable medium detection embodiment of a rewritable medium printer according to the present invention.

FIG. 6AA shows a pair of writing electrodes 270 located in the normally unprinted margin of a sheet of rewritable paper 140 along the printer paper path and upstream from a photosensor 280. While known manner linear or matrixed array electrode technology may be employed for the electrodes, note additionally, the electrochromic molecular colorant is spatially addressable at its molecular (Angstrom) scale, allowing far greater image resolution than with toner or the tens-of-microns-scale of microcapsule colorants. Large electrodes are preferred as small electrodes may produce hard to read demarcations.

The electrodes 270 are voltage biased to align all colorant molecules to a common state orientation, e.g., a color or black. When a print media sheet enters this section of the printer, the electrodes 270 are energized, so that if the paper is rewritable paper the black print patch will be imaged. If, on the other hand, the paper is not rewritable, no black image will be formed by the electrodes 270. Thus, the photosensor 280 then becomes a feedback path to determine whether the medium entering the path is conventional or rewritable "paper." Any print patch formed in this way may be erased by the erase station 230, viz., a second set of inversely polarized electrodes located downstream of the photosensor 280, or perhaps by the photoconductor 210 itself as described previously. Clearly, a number of different devices can be used to form the described print patch. In addition to the parallel plate electrodes 270 shown, a pair of roller electrodes, edge electrodes, or combinations of these can be used.

In an alternative embodiment, the photosensor 280 of FIGS. 6AA and 7AA may be placed between the erase station 230 and write station 240 of the system 180 of FIG. 1AA. In this instance, the erase station 230 is biased to produce a solid black image on rewritable paper 140, and, of course, no image (leaving white) for conventional paper. The photosensor 280, then, is positioned to detect the presence of black or white medium surface color as a determinant of the presence of rewritable or conventional "paper," respectively.

In any of these detection schemes a second photosensor can be located approximate to but on the opposite side of the print medium to detect if the rewritable sheet has been loaded into the printer upside down. In this case, a series of reversed polarity pulses would be issued by the pair of writing electrodes to produce a series of black bars and spaces. The detector facing the recording layer of the rewritable medium will receive the bar pattern signal.

Alternately, if an upside down sheet is detected, a sophisticated printer can mirror image the data written to the photoconductor to produce the correct right-reading image on the underside of the sheet.

FIG. 7AA shows a schematic view of a simple augmentation of a conventional laser printer 300 to include the rewritable media or plain paper printing process. Fundamentally, for this embodiment, only the writing 270 and erasing 230 electrodes plus photosensor 280 to detect whether the current medium is plain paper or the rewritable medium of the present invention have been added to the conventional printer. Here, also, the standard transfer roller 330, used in conventional laser printers to strip toner from the photoconductor 210 onto the paper, serves in place of the back electrode 250 shown in FIG. 1AA. It is noted that many laser printers use a back electrode as shown in FIG. 1AA to transfer toner. Normally, however, the transfer roller is biased at about 2000 volts.

Optionally, the transfer roller 330 may be turned off. In this instance, the charge field produced by the photoconductor 210 alone may produce sufficient field to actuate the colorant molecules. The fuser 290 used in this printer 300 is preferably an "instant on" type consisting of a low thermal mass heater that rises and falls rapidly in temperature when powered on and off, respectively. It is worth noting here that under the right transfer roller 330 bias setting the need for the erasing electrodes 230 can be eliminated.

Referring also to the discussion of FIG. 1AA, should the transfer roller produce a charge bias on the bottom of the rewritable paper 140 of −350V, given the same example, the writing and erasing fields will be equal in magnitude while opposite in polarity.

Figure 10A:
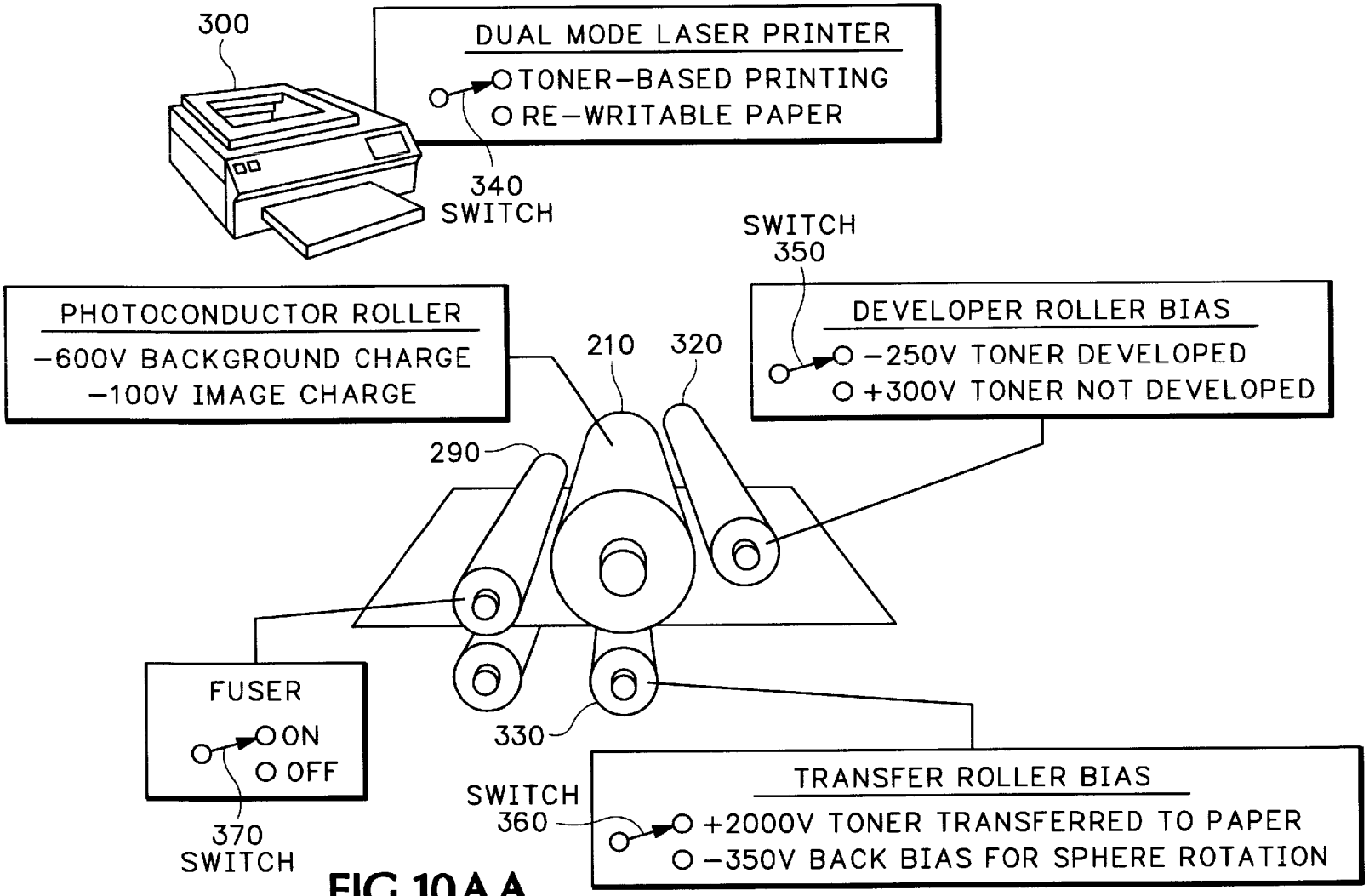
FIG. 10AA is a diagram illustrating bias control settings for a dual-mode printer embodiment of a rewritable medium printer according to the present invention.

Alternately, the photosensor 280 and writing electrodes 270 can be replaced with a user activated switch to indicate whether conventional or rewritable paper is being used. FIG. 10AA is a diagram illustrating bias control settings for a dual-mode printer embodiment of a rewritable medium printer according to the present invention. When a user sets switch 340 of dual-mode printer 300 from rewritable paper mode to toner-based printing, the settings for switches 350, 360 and 370 are changed. Switch 350 controls developer roller 320 bias. Setting switch 340 to toner-based print mode causes switch 350 to change the developer roller 320 bias from +300V (toner not developed) to −250V (toner developed). Similarly, switch 360 controls transfer roller 330 bias. Setting switch 340 to toner-based print mode causes switch 360 to change the transfer roller 330 bias from −350V to +2000V (toner transferred to paper). Finally, switch 370 controls fuser 370. Setting switch 340 to toner-based print mode causes switch 370 to change the fuser 290 power supply from "off" (no fusing or re-write medium) to "on" (fuse toner to paper).

Thus a wide variety of product options exist, including changing the transfer roller 330 voltage, for controlling the printing of conventional and rewritable paper. In the simplest embodiment, a standard laser printer 300, that is shown in FIG. 7AA minus the writing 270 and erasing 230 electrodes and photosensor 280, is used with a host computer enable switch for paper setting. When conventional paper and toner printing is desired, the transfer roller 330 and development roller 320 voltages are set for toner development and transfer and the fuser 290 temperature is set to normal fusing. When rewritable paper 140 is used, the transfer roller 330 is set to allow simultaneous old image erase and new image write by the photoconductor 210, the developer 320 bias is set to prohibit toner development, and the fuser 290 heater is deactivated. Examples of each of the voltage settings have been described earlier in this entry. In this instance, only the controller and formatter circuit logic needs to be modified, while the basic engine may be kept intact.

As stated earlier in previous entries, a stand-alone rewritable media printer can be made far simpler than a conventional toner-based laser printer. Referring to FIG. 7AA, such a printer would eliminate the need for the toner developer 310, fuser 290 and toner cleaning station (not shown but normally acting on photoconductor 210). The same printer will not require the paper type sensor 280 and electrodes 270 shown in FIG. 7AA. In this instance, a rewritable paper 140 could have its image written and prior image erased as described for the printer of FIG. 1AA.

Two-Sided Rewritable Medium

Figure 11A:
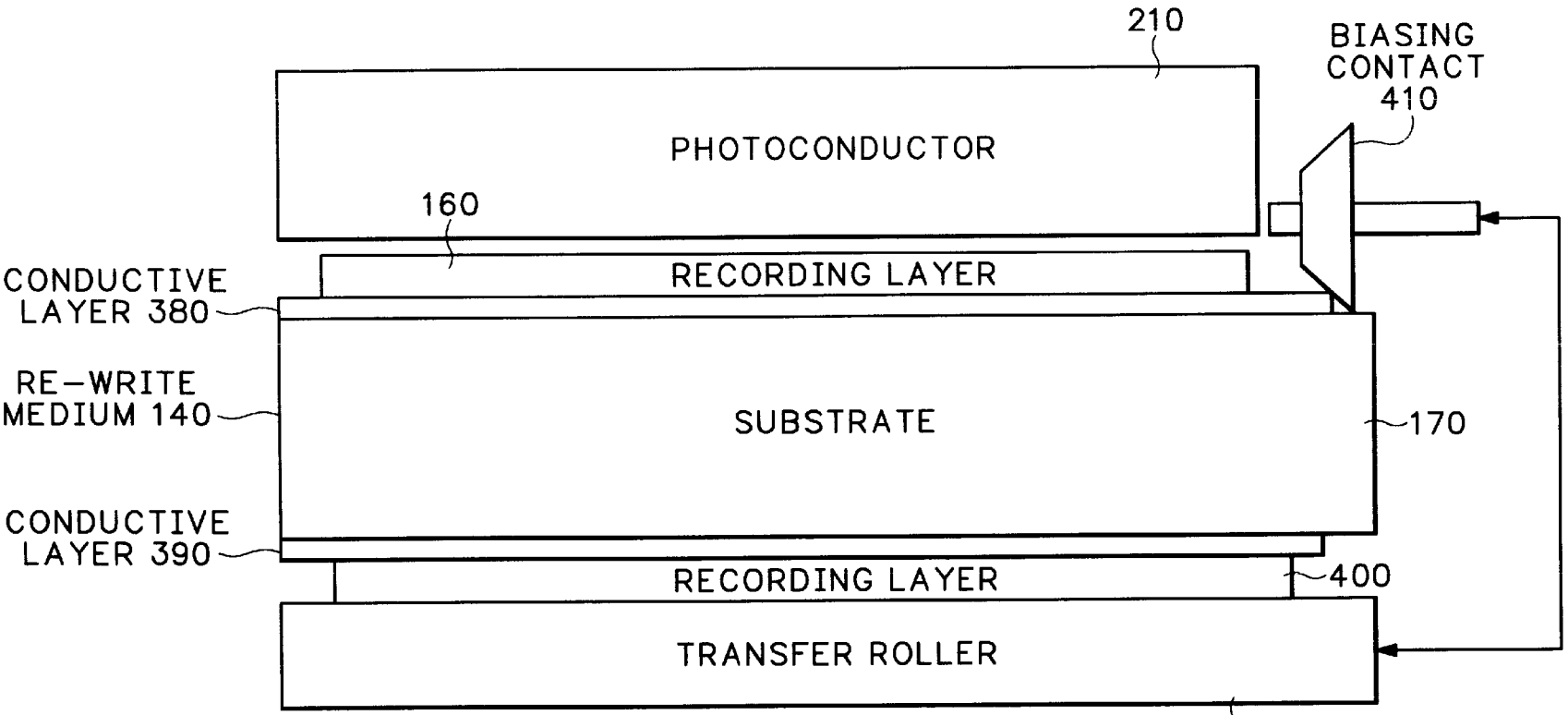
FIG. 11AA is an alternative embodiment of a rewritable medium printer according to the present invention for two-sided rewritable media.

Although the previous discussion has focused on single-sided rewritable media, it is possible to make a rewritable medium that has recording layers on each side of the substrate sheet. FIG. 11AA illustrates such a two-sided rewritable medium system. In FIG. 11AA, conductive layer 380 has been added to re-write medium 140 between recording layer 160 and substrate 170. Biasing contact 410, in this case a small wheel, physically contacts conductive layer 380 as re-write medium 140 passes by photoconductor 210. Biasing contact 410 is electrically coupled to transfer roller 330. Thus, an electric field is established between conductive layer 380 and photoconductor 210 to cause an image to be recorded by recording layer 160.

However, because conductive layer 380 is biased to the same potential as transfer roller 330, no such field will form between the transfer roller 330 and conductive layer 380. Therefore, any image stored on recording layer 400 will not be changed when writing to recording layer 160.

For one embodiment, conductive layers 380 and 390 are clear or white conductive polymer coating layers that have been deposited on substrate 170. Alternately, substrate 170 itself can be formed from a conductive material.

Although biasing contact 410 is shown to be a wheel, alternate contact mechanisms such as brushes can be employed. Furthermore, a second biasing contact can be placed on the side of substrate 170 closest to transfer roller 330. The second biasing contact would thus make contact with recording layer 400. This would permit the use of a single conductive layer placed on only one side of substrate 170. For yet another embodiment, one or more conductive layers could be formed within substrate 170 and contacted from the side (e.g., by a brush).

In summary, the rewritable medium and printers presented herein provide many advantages.

One benefit is a significantly lower cost per printed page. The rewritable "paper" may be electrostatically printed, erased and reprinted likely indefinitely or at least until the substrate is worn to an extent where paper jam problems may occur. The anticipated cost per print, irrespective of the print density, is expected to be at least an order of magnitude less per simple text printed page than for laser and ink-jet printers.

The rewritable medium printing process has no consumable. The "ink" is in the medium and is bistable, e.g., either black or white paper. There is no toner, ink or cartridge to purchase, replace or dispose of. This benefit not only provides an environmentally "green" printer solution, but eliminates the cost and "hassle" factor associated with the purchase, exchange and disposal of cartridges.

The rewritable medium can have a paper-like appearance and feel. The design of the present invention allows incorporation of the bichromal colorant in coatings analogous to conventional pigment-based surface coatings. Such coatings can be applied to either conventional paper or paper-like substrates, giving the rewritable paper of the present invention a rather paper-like appearance and feel. This is in stark contrast to the oil swollen, polymer-based substrate described by Sheridon.

The rewritable medium has improved print quality. The colorant in the rewritable medium is fixed in location and within the medium surface coating and is written through a direct contact print with the electric field writing means. This is in sharp contrast to conventional printing methods wherein the colorant is transferred by drop ejection or electrostatic charge transfer from the writing means to the medium. With transferred colorant there is noticeable dot gain from ink wicking, splatter and satellite drops, in the case of ink-jet, and electrostatic scattering and background development of wrong sign toner in the case of electrophotography. Such dot gain is not anticipated with the rewritable medium technology of the present invention.

The rewritable medium provides improved paper and image durability. The molecular colorant design of the present invention eliminates any damage as might occur with the microcapsule colorant due to externally applied forces, such as sheet folding or pressure from objects in contact with the sheet surface. For example, the Sheridon dichroic sphere floats in a flexible sheet cavity that may partially or fully collapse when subjected to the same external forces.

The bi-modal and dedicated laser printers in accordance with the present invention have a lower product cost than an electrode array device. The combined cost of a photoconductor drum and laser scanner is anticipated to be lower in product cost than a page wide electrode array and its estimated 2400 to 4800 dedicated high voltage drivers for 300 and 600 dpi printing, respectively.

The bi-modal and dedicated laser printers in accordance with the present invention have a higher print speed. The larger nip area of laser printers should allow over 20 times the rewritable print speed over electrode array printers.

The bi-modal and dedicated laser printers in accordance with the present invention have a higher print resolution. Standard optics and photoconductor responsivities of laser printers allow print resolutions up to 1200 dpi. It is believed that the high cost interconnects and high voltage drivers will limit electrode array printers to substantially lower practical resolutions (e.g., 300 dpi).

Furthermore, the bi-modal operation itself is an advantage. A standard laser printer engine is capable of printing both conventional (toner) and rewritable (toner-less) paper types for easy adoption of rewritable paper. The Sheridon electrode array printer, supra, is a dedicated rewritable paper printer only.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for . . . " and no process step herein is to be construed under those provisions unless the step or steps are expressly recited using the phrase "comprising the step(s) of . . . "

What is claimed is:

1. A hard copy system comprising:

a rewritable medium having a molecular colorant; and a laser printer for generating electric fields associated with said molecular colorant for writing and erasing a print image therewith.

2. The hard copy system as set forth in claim 1 said laser printer further comprising:

a photoconductor means for storing a voltage charge deposited thereon;

writing means for writably erasing the charge deposited on the photoconductor means; and support means for holding the rewritable medium proximate to the photoconductor means in a nip contact area such that when the rewritable medium passes a charge written on the photoconductor means, fields generated from the photoconductor means cause a molecular state change of pixel locations of said molecular colorant to develop a print image on the rewritable medium.

3. The hard copy system as set forth in claim 2 wherein the support means is biased such that the fields are generated between the photoconductor means and the support means and cause said molecular state change.

4. The hard copy system as set forth in claim 2 wherein the support means and the photoconductor means are biased so as to apply approximately equal magnitude but opposite direction fields to the rewritable medium when the photoconductor is respectively charged and discharged.

5. The hard copy system as set forth in claim 1, said molecular colorant comprising:

a molecular system, said molecular system including electrochromic, switchable molecules, each of said molecules being selectively switchable between at least two optically distinguishable states, wherein said molecular system is distributable on the medium thereby forming an erasably writable surface.

6. The hard copy system as set forth in claim 5 comprising:

said molecules exhibit an electric field induced band gap change.

7. The hard copy system as set forth in claim 6 comprising:

said electric field induced band gap change occurs via a mechanism selected from a group including (1) molecular conformation change or an isomerization, (2) change of extended conjugation via chemical bonding change to change the band gap, and (3) molecular folding or stretching.

8. The hard copy system as set forth in claim 5 wherein said at least two optically distinguishable states are a transparent state and a high contrast color state.

9. The hard copy system as set forth in claim 1 further comprising:

means for laser printing plain paper; and medium type detection means for discriminating between presence of the rewritable medium and presence of plain paper and for switching said system between plain paper printing and rewritable medium printing operation modes.

10. The hard copy system as set forth in claim 1 further comprising:

said rewritable medium having said molecular colorant distributed on at least one surface thereof.

11. The hard copy system as set forth in claim 10 further comprising:

said laser printer is adapted for simultaneously writing two surfaces of said rewritable medium.

12. A printer for a rewritable medium, the printer comprising:

a photoconductor means for storing a voltage charge deposited thereon;

writing means for writably erasing the charge deposited on the photoconductor means; and support means for holding the rewritable medium proximate to the photoconductor means in a nip contact area such that when the rewritable medium passes a charge written on the photoconductor means, fields generated from the photoconductor means cause a molecular state change of pixel locations of molecular colorant of said medium to develop a print image on the rewritable medium.

13. The printer as set forth in claim 12 wherein the support means is biased such that the fields are generated between the photoconductor means and the support means and cause said molecular state change.

14. The printer as set forth in claim 12 wherein the support means and the photoconductor means are biased so as to apply approximately equal magnitude but opposite direction fields to the rewritable medium when the photoconductor is respectively charged and discharged.

15. The printer as set forth in claim 12 wherein said molecular colorant is a molecular system, said system including electrochromic, switchable molecules, each of said molecules being selectively switchable between at least two optically distinguishable states, wherein said system is distributable on the medium thereby forming an erasably writable surface.

16. The printer as set forth in claim 15 wherein said molecules exhibit an electric field induced band gap change.

17. The printer as set forth in claim 16 wherein said electric field induced band gap change occurs via a mechanism selected from a group including (1) molecular conformation change or an isomerization, (2) change of extended conjugation via chemical bonding change to change the band gap, and (3) molecular folding or stretching.

18. The printer as set forth in claim 12 further comprising:

means for laser printing plain paper; and medium type detection means for discriminating between presence of the rewritable medium and presence of plain paper and for switching said system between plain paper printing and rewritable medium printing operation modes.

19. The printer as set forth in claim 12 wherein said rewritable medium has said molecular colorant distributed on at least one surface thereof.

20. The printer as set forth in claim 19 further comprising:

said laser printer is adapted for simultaneously writing two surfaces of said rewritable medium.

21. A printing process comprising:

depositing an electric charge distribution on a photoconductor wherein said distribution is representative of a printing image;

writably erasing the charge deposit deposited on the photoconductor; and transporting a rewritable medium proximate to the photoconductor through a nip contact are, the rewritable medium having at least one layer of a molecular colorant such that when the rewritable medium passes the charge written photoconductor, fields generated from the photoconductor cause a molecular state change of pixel locations of said molecular colorant and thereby developing a print image associated with said writably erasing.

22. The process as set forth in claim 21 wherein said molecular colorant is a molecular system, said system including electrochromic, switchable molecules, each of said molecules being selectively switchable between at least two optically distinguishable states, wherein said system is distributable on the medium thereby forming an erasably writable surface.

23. The process as set forth in claim 22 wherein said molecules exhibit an electric field induced band gap change.

24. The process as set forth in claim 23 wherein said electric field induced band gap change occurs via a mechanism selected from a group including (1) molecular conformation change or an isomerization, (2) change of extended conjugation via chemical bonding change to change the band gap, and (3) molecular folding or stretching.

25. A method of doing business, the method comprising:

receiving digital data representative of a document; and printing said document on a rewritable medium having a molecular colorant by using a laser printer for generating electric filed associated with said molecular colorant for writing and erasing a print image therewith.

26. The method as set forth in claim 25 wherein said molecular colorant is a molecular system, said system including electrochromic, switchable molecules, each of said molecules being selectively switchable between at least two optically distinguishable states, wherein said system is distributable on the substrate thereby forming an erasably writable surface.

27. The method as set forth in claim 26 wherein said molecules exhibit an electric field induced band gap change.

28. The method as set forth in claim 27 wherein said electric field induced band gap change occurs via a mechanism selected from a group including (1) molecular conformation change or an isomerization, (2) change of extended conjugation via chemical bonding change to change the band gap, and (3) molecular folding or stretching.

29. A method of manufacturing a laser printer for rewritable media, the method comprising:

providing a chassis;

mounting to said chassis a photoconductor means for storing a voltage charge deposited thereon;

mounting in association with said photoconductor means, a writing means for writably erasing the charge deposited on the photoconductor means; and mounting support means for holding rewritable medium proximate to the photoconductor means in a nip contact area such that when the rewritable medium passes a charge written on the photoconductor means, fields generated from the photoconductor means cause a molecular state change of pixel locations of molecular colorant of said medium to develop a print image on the rewritable medium.

30. A method of doing business comprising:

receiving digital data representative of a document; and using a laser hard copy apparatus, transferring said data to a rewritable medium having a molecular colorant wherein said apparatus causes a molecular state change of molecules in pixel locations of said medium.

31. A method of printing with a laser printer, the method comprising:

receiving digital data representative of printed text, images or both; and converting said digital data to a printing formatted data set; and printing said data set into a molecular colorant layer of print medium wherein said laser printer causes a molecular state change of molecules in picture element locations of said medium.

32. The method as set forth in claim 31, wherein said molecular colorant layer is a molecular system, said system including electrochromic, switchable molecules, each of said molecules being selectively switchable between at least two optically distinguishable states, wherein said system is distributed on the substrate thereby forming an erasably writable surface.

33. The method as set forth in claim 32 wherein said molecules exhibit an electric field induced band gap change.

34. The method as set forth in claim 33 wherein said electric field induced band gap change occurs via a mechanism selected from a group including (1) molecular conformation change or an isomerization, (2) change of extended conjugation via chemical bonding change to change the band gap, and (3) molecular folding or stretching.

* * * * *